US008192552B2

(12) United States Patent
Chang

(10) Patent No.: US 8,192,552 B2
(45) Date of Patent: Jun. 5, 2012

(54) DETERGENT COMPOSITION COMPRISING A BLOCK COPOLYMER

(75) Inventor: Jeanne Chang, Madison, NJ (US)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 12/390,233

(22) Filed: Feb. 20, 2009

(65) Prior Publication Data

US 2009/0186794 A1 Jul. 23, 2009

Related U.S. Application Data

(63) Continuation of application No. 11/403,761, filed on Apr. 13, 2006, now abandoned, which is a continuation of application No. 10/364,224, filed on Feb. 11, 2003, now abandoned.

(60) Provisional application No. 60/356,060, filed on Feb. 11, 2002.

(51) Int. Cl.
*B08B 3/04* (2006.01)
*C11D 3/37* (2006.01)
*C11D 1/00* (2006.01)

(52) U.S. Cl. ..... 134/25.2; 134/25.3; 134/39; 134/42; 510/223; 510/229; 510/434; 510/475; 510/477; 510/535

(58) Field of Classification Search ..... 510/223, 510/229, 434, 475, 477, 535; 424/25.2, 25.3, 424/39, 42; 134/25.2, 25.3, 39, 42
See application file for complete search history.

(56) References Cited

U.S. PATENT DOCUMENTS

| | | | | |
|---|---|---|---|---|
| 1,985,424 | A | 12/1934 | Piggott | |
| 2,182,306 | A | 12/1939 | Ulrich et al. | |
| 2,208,095 | A | 7/1940 | Esselmann et al. | |
| 2,553,696 | A | 5/1951 | Wilson | |
| 2,703,798 | A | 3/1955 | Schwartz | |
| 2,792,372 | A | 5/1957 | Dickinson | |
| 2,806,839 | A | 9/1957 | Crowther | |
| 2,965,576 | A | 12/1960 | Wilson | |
| 3,033,746 | A | 5/1962 | Mayle et al. | |
| 3,308,067 | A | 3/1967 | Diehl | |
| 3,646,015 | A | 2/1972 | Hamilton | |
| 3,812,044 | A | 5/1974 | Connor et al. | |
| 3,893,929 | A | 7/1975 | Basadur | |
| 3,929,678 | A | 12/1975 | Laughlin et al. | |
| 3,959,230 | A | 5/1976 | Hays | |
| 4,000,093 | A | 12/1976 | Nicol et al. | |
| 4,201,824 | A | 5/1980 | Violland et al. | |
| 4,228,044 | A | 10/1980 | Cambre | |
| 4,240,918 | A | 12/1980 | Lagasse et al. | |
| 4,525,524 | A | 6/1985 | Tung et al. | |
| 4,565,647 | A | 1/1986 | Llenado | |
| 4,579,681 | A | 4/1986 | Ruppert et al. | |
| 4,663,071 | A | 5/1987 | Bush et al. | |
| 4,664,848 | A | 5/1987 | Oh et al. | |
| 4,702,857 | A | 10/1987 | Gosselink | |
| 4,704,233 | A | 11/1987 | Hartman et al. | |
| 4,711,730 | A | 12/1987 | Gosselink et al. | |
| 4,721,580 | A | 1/1988 | Gosselink | |
| 4,746,456 | A | 5/1988 | Kud et al. | |
| 4,787,989 | A | 11/1988 | Fanelli et al. | |
| 4,790,856 | A | 12/1988 | Wixon | |
| 4,877,896 | A | 10/1989 | Maldonado et al. | |
| 4,956,447 | A | 9/1990 | Gosselink et al. | |
| 4,968,451 | A | 11/1990 | Scheibel et al. | |
| 5,415,807 | A | 5/1995 | Gosselink et al. | |
| 5,431,846 | A * | 7/1995 | Christopher et al. | 510/230 |
| 5,446,762 | A | 8/1995 | Ohba et al. | |
| 5,691,298 | A | 11/1997 | Gosselink et al. | |
| 5,755,992 | A * | 5/1998 | Jeffrey et al. | 252/186.38 |
| 6,153,705 | A | 11/2000 | Corpart et al. | |
| 6,677,293 | B1 | 1/2004 | Allgaier et al. | |
| 6,777,513 | B1 | 8/2004 | Destarac et al. | |
| 7,247,688 | B2 | 7/2007 | Destarac et al. | |
| 2003/0109414 | A1 * | 6/2003 | Raether et al. | 510/475 |
| 2003/0187165 | A1 | 10/2003 | Destarac | |

FOREIGN PATENT DOCUMENTS

| | | | |
|---|---|---|---|
| CA | 997242 | A1 | 9/1976 |
| CA | 2042089 | | 11/1991 |
| DE | 10029696 | A1 | 12/2001 |
| EP | 0066915 | A2 | 12/1982 |
| EP | 0193360 | | 9/1986 |
| GB | 809060 | | 2/1959 |
| WO | WO 90/01815 | | 2/1990 |
| WO | WO 91/08281 | | 6/1991 |
| WO | WO 94/17170 | | 8/1994 |
| WO | WO 95/07971 | | 3/1995 |
| WO | WO 96/30421 | | 10/1996 |
| WO | WO 98/26036 | | 6/1998 |
| WO | WO 98/28393 | | 7/1998 |
| WO | WO 98/01478 | | 10/1998 |
| WO | WO 98/58974 | | 12/1998 |
| WO | WO 99/03894 | | 1/1999 |
| WO | WO 99/31144 | | 6/1999 |
| WO | WO 99/31213 | | 6/1999 |
| WO | WO 99/35177 | | 7/1999 |
| WO | WO 99/35178 | | 7/1999 |
| WO | WO 00/12660 | | 3/2000 |
| WO | WO 00/71660 | | 11/2000 |
| WO | WO 01/96515 | * | 12/2001 |
| WO | WO 02/26836 | | 4/2002 |

OTHER PUBLICATIONS

Braun, Dietrich; Initiation of Free Radical Polymerization by Thermal Cleavage of Carbon-Carbon Bonds; Macromol. Symp. 111; pp. 63-71, 1996.

(Continued)

*Primary Examiner* — Brian P Mruk
(74) *Attorney, Agent, or Firm* — Hunton & Williams, LLP

(57) ABSTRACT

The invention relates to a detergent composition, suitable for use in dish washing or laundry, comprising at least 15% of a detersive surfactant(s), and a block copolymer, selected from the group consisting of (block A)-(block B) diblock copolymers, (block A)-(block B)-(block A) triblock copolymers, and (block B)-(block A)-(block B) triblock copolymers, wherein block A and block B derive from alpha ethylenically unsaturated monomers, at least one block being water-soluble. The detergent compositions provide an increased cleaning, and/or a decreased redeposition of the fatty substances once they are removed from a substrate.

18 Claims, No Drawings

OTHER PUBLICATIONS

Matyjaszewski, Krzysztof; Communications to the Editor; Macromolecules 1995, 28, pp. 2093-2095.

Otsu, Takayuki, et al.; Role of Initiator-Transfer Agent-Terminator (Iniferter) in Radical Polymerizations: Polymer Design by Organic Disulfides as Iniferters; Makromol. Chem., Rapid Commun. 3, 127-132 (1982).

Quirk, Roderic P.; Experimental Criteria for Living Polymerizations; Polymer International 27 (1992), pp. 359-367.

Schmolka, Irvin R.; Journal of the American Oil Chemists' Society, 1977, vol. 54, pp. 110-116, Mar. 1977.

Wayland, Bradford B., et al.; Living Radical Polymerization of Acrylates by Organocobalt Porphyrin Compleses; J. Am. Chem. Soc. 1994; 116; pp. 7943-7944.

Webster, O. W.; Group-Transfer Polymerization; "Encyclopedia of Polymer Science and Engineering", pp. 580-588; vol. 7, edited by H.F. Mark, N.M. Bikales, C. G. Overberger and G. Menges, Wiley Interscience, New York, 1987.

Wilczek-Vera, Grazyna, et al.; Individual Block Length Distributions of Block Copolymers of Polystyrene-*block*-Poly(a-methyllstyrene) by MALDI/TOF Mass Spectrometry; Macromolecules 1996, 29, 4036-4044.

Communication of a notice of opposition; Application No. EP03739467.3; Patent No. EP1483362; published in European Patent Bulletin dated May 20, 2009.

* cited by examiner

DETERGENT COMPOSITION COMPRISING A BLOCK COPOLYMER

CROSS REFERENCES TO RELATED APPLICATIONS

This application is a continuation of U.S. patent application Ser. No. 11/403,761, filed Apr. 13, 2006, now abandoned, which is a continuation of U.S. patent application Ser. No. 10/364,224, filed Feb. 11, 2003, now abandoned, which claims priority to U.S. Provisional Application No. 60/356,060 filed on Feb. 11, 2002.

BACKGROUND OF THE INVENTION

The invention relates to a detergent composition suitable for use in dish washing or laundry. The composition comprises a block copolymer. The composition according to the invention presents an increased cleaning and/or a decreased redeposition of fatty substances once they are removed from a substrate.

Typical detergent compositions, as well dish washing compositions and laundry compositions, are based on detersive surfactants. Detersive surfactants remove fatty substances from the product to be washed. Other compounds are usually added to modify the properties or the compositions, for different purposes. Dish washing and laundry compositions are usually commercialized in a concentrate form, and diluted with water by consumers at time of use. Thus, dish washing and laundry compositions comprise usually more than 15% surfactants in addition to other additives.

Use of the compositions may be very different, depending of the consumer. Some consumers use the compositions in highly dilute form while some, especially in hand dish washing, almost use it in the concentrate form.

Performance of the detersive surfactants depends on the chemical structure of the compounds used as surfactants, and partly on their concentration and relative composition. However, there is usually a concentration value above which using more detersive surfactant is not more effective. There is a need for improving the cleaning efficiency of detersive surfactant composition, either by allowing the use of less surfactant with an equivalent effect, or by using the same amount of surfactant and delivering an increased effect.

Adding some compounds to increase the cleaning efficiency of detersive surfactants is known. Document WO 98/28393 for example describes using diamines.

Fatty substances form droplets in an aqueous phase. Coalescence of these droplets may occur, and a re-deposition may occur on the substrate, which is undesirable. Such a re-deposition may cause the users to think washing performance was not good. Some visible traces may also remain on the substrate because of coalescence and re-deposition.

Adding some compounds to prevent coalescence and re-deposition is known. Document WO 98/26036 for example describes using selected polymers having a hydrophilic backbone and hydrophobic side chains.

Many documents describe adding polymers to modify various properties of detergent compositions.

Document WO 00/71660 describes using block copolymers comprising a cationic block and a neutral block as a suds booster in hand dish washing compositions.

Document WO 00/12660 teaches suppression of lamellar mesophases of surfactants in making microemulsions by adding a diblock or triblock hydrophilic-hydrophobic copolymer. Suppression of lamellar mesophases is referred in this document as "increasing the efficiency of surfactants".

Experiments described in this document have been performed with a polyisoprene-block-polyethylene copolymer. Concentrations of surfactants and copolymers in the experiments are comprised between 4% of surfactant, with a ratio copolymer/(surfactant+copolymer) of 12%, and 18% of surfactant, with a ratio copolymer/(surfactant+copolymer) of 1.5%.

However, detergent compositions, when used usually do not present lamellar mesophases. Formation of lamellar mesophases occurs in very particular conditions, depending on temperature and surfactant concentration. When a detergent composition is diluted, the concentration of the detersive surfactant is usually below 4%, and even below 1%. Moreover, the block copolymer disclosed in document WO 00/12660 is difficult to formulate in a concentrate detergent composition to be diluted for use. Said block copolymer may phase separate from other compounds of the composition, and thus confer upon the composition poor mixing and stability, which affects its performance and aesthetic properties.

BRIEF SUMMARY OF THE INVENTION

Applicants have found that presence of selected diblock or triblock copolymers in detergent compositions improves cleaning efficiency of detersive surfactants, and prevents, or retards, the coalescence of droplets of removed fatty substances (anti-redeposition effect), while said copolymers remain easy-to-formulate, especially in compositions comprising a high amount of detersive surfactants.

Thus, the invention relates to a detergent composition, suitable for use in dish washing or laundry, comprising:

at least 15% of detersive surfactant(s)

a block copolymer, selected from the group consisting of (block A)-(block B) diblock copolymers, (block A)-(block B)-(block A) triblock copolymers, and (block B)-(block A)-(block B) triblock copolymers, wherein block A and block B derive from alpha-ethylenically-unsaturated monomers, preferably mono-alpha-unsaturated monomers, at least one block being water-soluble, and wherein:

block A and block B are neutral blocks at pH the composition is used, block A being more hydrophilic than block B, block A is a water-soluble block which is neutral at pH the composition is used, and block B is a water-soluble block which is anionic block at pH the composition is used, or block A is a hydrophobic block which is neutral at pH the composition is used, and block B is a water-soluble block which is anionic and at pH the composition is used.

A second aspect of the present invention provides a laundry process, or a dish washing process, for example a hand dish washing process, which comprises the step of treating the substrate to be washed with a composition described above, in neat or dilute form.

A third aspect of the present invention relates to the use of a block polymer as described above, with detersive surfactants, as a cleaning enhancing agent, or as an agent for enhancing the removal of fatty soils.

A fourth aspect of the present invention relates to the use of a block polymer as described above, with detersive surfactants, as an anti-redeposition agent.

DETAILED DESCRIPTION OF THE INVENTION

Definitions

In the present specification, the molecular weight of a polymer, copolymer or a block refers to the weight-average molecular weight of said polymer, copolymer or block. The weight-average molecular weight of the polymer or copolymer can be measured by gel permeation chromatography (GPC). In the present specification, the molecular weight of a block refers to the molecular weight calculated from the amounts of monomers, polymers, initiators and/or transfer agents used to make the said block. The one skilled in the art knows how to calculate these molecular weights. The ratios by weight between blocks refer to the ratios between the amounts of the compounds used to make said blocks, considering an extensive polymerization.

Typically, the molecular weight M of a block is calculated according to the following formula:

$$M = \sum_i M(i) * \frac{n(i)}{n(\text{precursor})}$$

wherein M(i) is the molecular weight of a monomer i, n(i) is the number of moles of a monomer i, and n(precursor) is the number of moles of a compound the macromolecular chain of the block will be linked to. Said compound may be a transfer agent or a transfer group, or a previous block. If it is a previous block, the number of moles may be considered as the number of moles of a compound the macromolecular chain of said previous block has been linked to, for example a transfer agent or a transfer group. It may be also obtained by a calculation from a measured value of the molecular weight of said previous block. If two blocks are simultaneously grown from a previous block, at both ends, the molecular weight calculated according to the above formula should be divided by two.

In the present specification, a unit deriving from a monomer is understood as a unit that may be directly obtained from the said monomer by polymerizing. Thus, a unit deriving from an ester of acrylic or methacrylic acid does not encompass a unit of formula —CH—CH(COOH)—, —CH—C($CH_3$)(COOH)—, —CH—CH(OH)—, —CH—C($CH_3$)(OH)—, obtained for example by polymerizing an ester of acrylic or methacrylic acid, or a vinyl acetate, and then hydrolyzing. A unit deriving from acrylic acid or methacrylic acid encompasses for example a unit obtained by polymerizing a monomer (for example an alkyl acrylate or methacylate) and then reacting (for example hydrolyzing) to obtain units of formula —CH—CH(COOH)— or —CH—C($CH_3$)(COOH)—. A unit deriving from vinyl alcohol encompasses for example a unit obtained by polymerizing a monomer (for example a vinyl ester) and then reacting (for example hydrolyzing) to obtain units of formula —CH—CH(OH)— or —CH—C($CH_3$)(OH)—.

Water-solubility, hydrophilic or hydrophobic properties of a block refer to the water-solubility that said block would have without the other block(s), that is the water-solubility of a polymer consisting of the same repeating units than said block, having the same molecular weight. By water-soluble block, polymer or copolymer, it is meant that the block, polymer or copolymer does not phase separate macroscopically in water at a concentration from 0.01% and 10% by weight, at a temperature from 20° C. to 30° C.

A first block being more hydrophilic than a second block means either:

- that the first block does not phase-separate within a wider concentration range than the second block, or
- that there is no concentration range wherein the second block does not phase-separates, whereas there is a concentration range wherein the first block does phase separates.

By hydrophobic block, it is meant that a block phase-separates macroscopically in water at a concentration of from 0.1% and 1% by weight, at a temperature of from 20° C. to 30° C.

A block which is anionic at pH the composition is used refers to a block comprising anionic units whatever the pH, or to a block comprising units that may be neutral anionic depending on the pH (the units are potentially anionic). A unit that may be neutral or anionic, depending on the pH, will be thereafter referred as an anionic unit, or as a unit deriving from an anionic monomer, whatever it is in a neutral form or in an anionic form. An anionic block comprises several anionic units, and optionally some neutral units.

Block Copolymer

The block copolymer comprises at least two different blocks, block A, and block B. It is selected from the group consisting of (block A)-(block B) diblock copolymers, (block A)-(block B)-(block A) triblock copolymers, and (block B)-(block A)-(block B) triblock copolymers.

Block A and block B have different structures. They present at least one discriminating property being different one another. The difference in the discriminating property is a consequence of the different structures.

A block is usually defined by repeating units it comprises. A block may be defined by naming a polymer, or by naming monomers it derives from. A block may be a copolymer, comprising several kind of repeating units, deriving form several monomers. Hence, block A and block B are different polymers, deriving from different monomers, but they may comprise some common repeating units (copolymers). Block A and block B preferably do not comprise more than 50% of a common repeating unit (deriving from the same monomer).

Block A and block B are discriminated as regard to their electrical behavior or nature, and as regard to their hydrophilic or hydrophobic property. As regard to the electrical behavior, each block may be neutral or anionic at pH the composition is used. Compositions according to the invention are usually used in aqueous conditions wherein pH is between 5.0 and 10, preferably between 7.0 and 9.0, and more preferably between 8.0 and 9.0. Being neutral or anionic, each block may be water-soluble or not, and more or less hydrophilic or hydrophobic.

Several types of block copolymers may be used:

Type 1: block A and block B are neutral blocks at pH the composition is used, block A being more hydrophilic than block B.

Type 2: block A is a water-soluble block which is neutral at pH the composition is used, and block B is a water-soluble block which is anionic block at pH the composition is used.

Type 3: block A is a hydrophobic block which is neutral at pH the composition is used, and block B is a water-soluble block which is anionic and at pH the composition is used.

Block A and block B derive from alpha-ethylenically-unsaturated monomers, preferably from mono-alpha-ethylenically-unsaturated monomers. More precisely, it is meant that for block A and block B, at least 50% of the repeating units are units deriving from alpha-ethylenically-unsaturated monomers, preferably from mono-alpha-ethylenically-unsaturated monomers.

At least one block is a water-soluble block.

Examples of neutral blocks are blocks comprising units deriving from at least one monomer selected from the group consisting of:

- vinyl acetate,
- vinyl alcohol,
- vinyl pyrrolidone,
- acrylonitrile,
- amides of (mono-)alpha-ethylenically-unsaturated monocarboxylic acids,
- alkyl esters of (mono-)alpha-ethylenically-unsaturated monocarboxylic acids,
- vinyl nitrites,
- hydroxyalkylacrylates, hydroxyalkymethacrylates,
- vinylamine amides, and
- vinyl aromatic compounds.

Preferred neutral blocks are blocks comprising units derived from at least one monomer selected from the group consisting of:

- vinyl alcohol, vinyl acetate,
- vinyl pyrrolidone,
- acrylonitrile,
- styrene,
- acrylamide, methacrylamide,
- acrylonitrile,
- methylacrylate, ethylacrylate, n-propylacrylate, n-butylacrylate, methylmethacrylate, ethylmethacrylate, n-propylmethacrylate, n-butylmethacrylate, 2-ethylhexyl acrylate and
- 2-hydroxyethylacrylate, 2-hydroxyethylmethacrylate.

Examples of anionic blocks are blocks comprising units deriving from at least one monomer selected from the group consisting of:

- (mono-)alpha-ethylenically-unsaturated monomers comprising a phosphate or phosphonate group,
- (mono-)alpha-ethylenically-unsaturated monocarboxylic acids,
- monoalkylesters of (mono-)alpha-ethylenically-unsaturated dicarboxylic acids,
- monoalkylamides of (mono-)alpha-ethylenically-unsaturated dicarboxylic acids,
- (mono-)alpha-ethylenically-unsaturated compounds comprising a sulphonic acid group, and salts of (mono-)alpha-ethylenically-unsaturated compounds comprising a sulphonic acid group.

Preferred anionic blocks are blocks comprising derived from at least one monomer selected from the group consisting of:

- acrylic acid, methacrylic acid,
- vinyl sulphonic acid, salts of vinyl sulfonic acid,
- vinylbenzene sulphonic acid, salts of vinylbenzene sulphonic acid,
- alpha-acrylamidomethylpropanesulphonic acid, salts of alpha-acrylamidomethylpropanesulphonic acid
- 2-sulphoethyl methacrylate, salts of 2-sulphoethyl methacrylate,
- acrylamido-2-methylpropanesulphonic acid (AMPS), salts of acrylamido-2-methylpropanesulphonic acid, and
- styrenesulphonate (SS).

Although (mono-)alpha-ethylenically-unsaturated monocarboxylic acids such as acrylic acid or methacrylic acid are mentioned as anionic monomers, blocks deriving from these monomers may also be considered as neutral, depending on the pH at which the composition is used.

Examples of water-soluble blocks are blocks comprising units deriving from at least one monomer selected from the group consisting of:

- acrylamide, methacrylamide,
- vinyl pyrrolidone,
- vinyl alcohol,
- hydroxyalkylacrylates, hydroxyalkymethacrylates,
- (mono-)alpha-ethylenically-unsaturated monomers comprising a phosphate or phosphonate group,
- (mono-)alpha-ethylenically-unsaturated monocarboxylic acids,
- monoalkylesters of (mono-)alpha-ethylenically-unsaturated dicarboxylic acids,
- monoalkylamides of (mono-)alpha-ethylenically-unsaturated dicarboxylic acids,
- (mono-)alpha-ethylenically-unsaturated compounds comprising a sulphonic acid group, and salts of alpha ethylenically unsaturated compounds comprising a sulphonic acid group.

Preferred water-soluble blocks are blocks comprising units derived from at least one monomer selected from the group consisting of:

- acrylamide, methacrylamide,
- vinyl pyrrolidone,
- vinyl alcohol,
- 2-hydroxyethylacrylate,
- acrylic acid, methacrylic acid,
- vinyl sulphonic acid, salts of vinyl sulfonic acid,
- vinylbenzene sulphonic acid, salts of vinylbenzene sulphonic acid,
- alpha-acrylamidomethylpropanesulphonic acid, salts of alpha-acrylamidomethylpropanesulphonic acid
- 2-sulphoethyl methacrylate, salts of 2-sulphoethyl methacrylate,
- acrylamido-2-methylpropanesulphonic acid (AMPS), salts of acrylamido-2-methylpropanesulphonic acid, and
- styrenesulphonate (SS).

Examples of hydrophobic blocks are blocks comprising units derived from at least one monomer selected from the group consisting of:

- alkyl esters of (mono-)alpha-ethylenically-unsaturated monocarboxylic acids
- vinyl nitrites, comprising from 3 to 12 carbon atoms,
- vinylamine amides, and
- vinylaromatic compounds.

Preferred hydrophobic blocks are blocks comprising units derived from at least one monomer selected from the group consisting of:

- styrene,
- acrylonitrile,
- methylacrylate, ethylacrylate, n-propylacrylate, n-butylacrylate, methylmethacrylate, ethylmethacrylate, n-propylmethacrylate, n-butylmethacrylate, and 2-ethyl-hexyl acrylate.

Examples of alpha-ethylenically-unsaturated, preferably mono-alpha-ethylenically-unsaturated, monomers, are monomers selected from the group consisting of:

- amides of (mono-)-alpha-ethylenically-unsaturated carboxylic acids,
- alkyl esters of (mono-)alpha-ethylenically-unsaturated monocarboxylic acids,
- hydroxyalkylacrylates, hydroxyalkymethacrylates,
- vinyl nitrides,
- vinylamine amides, vinyl pyrrolidone,
vinyl alcohol, vinyl acetate,
vinyl aromatic compounds,
(mono-)alpha-ethylenically-unsaturated monocarboxylic acids,
monoalkylesters of (mono-)alpha-ethylenically-unsaturated dicarboxylic acids,
monoalkylamides of (mono-)alpha-ethylenically-unsaturated dicarboxylic acids,
(mono-)alpha-ethylenically-unsaturated compounds comprising a sulphonic acid group, and salts of ethylenically unsaturated compounds comprising a sulphonic acid group.

As regards type 1 block copolymers, block B may be hydrophobic and block A hydrophilic. Both block A and block B may be considered as hydrophilic, one being more hydrophilic than the other. For 2 given blocks, the man skilled in the art knows which one is more hydrophilic than the other. Some examples are given below:

blocks deriving from acrylamide monomers are considered as more hydrophilic than blocks deriving from styrene monomers,
blocks deriving from acrylamide monomers are considered as more hydrophilic than blocks deriving from alkyl (meth)acrylate monomers.

Usually, anionic blocks are considered as hydrophilic.

Preferred block copolymers comprised in compositions according to the invention are diblock (block A)-(block B) copolymers. Among these copolymers, more preferred are those wherein block A is a neutral hydrophobic block comprising units deriving from (mono-)alpha-ethylenically-unsaturated monomers, and block B is an anionic water-soluble block comprising units deriving from (mono-)alpha-ethylenically-unsaturated monomers, or those wherein block A is a neutral hydrophilic block comprising units deriving from (mono-)alpha-ethylenically-unsaturated monomers, and block B is an anionic water-soluble block comprising units deriving from (mono-)alpha-ethylenically unsaturated monomers.

Especially preferred diblock (block A)-(block B) copolymers are selected from the group consisting of:

block A deriving from vinyl alcohol monomers and block B deriving from acrylic acid monomers,
block B deriving from acrylic acid monomers and block A deriving from styrene monomers,
block B deriving from acrylic acid monomers and block A deriving from butylacrylate monomers,
block B deriving from acrylamide monomers and block A deriving from butylacrylate monomers,
block B deriving from 2-acrylamido-2-methylpropanesulphonic acid (AMPS) monomers and block A deriving from butylacrylate monomers,
block B deriving from acrylic acid monomers and block A deriving from acrylamide monomers,
block B deriving from acrylic acid monomers and block A deriving from both acrylic acid and styrene monomers (i.e. block B is a copolymer block).

There are several methods for making copolymer (c) comprising moieties A and B. In a particular embodiment, copolymer (c) is a block copolymer or a star copolymer. Some methods for making such copolymers are provided below.

It is possible for example to use anionic polymerization with sequential addition of 2 monomers as described for example by Schmolka, J. Am. Oil Chem. Soc. 1977, 54, 110; or alternatively Wilczek-Veraet et al., Macromolecules 1996, 29, 4036. Another method which can be used consists in initiating the polymerization of a block polymer at each of the ends of another block polymer as described for example by Katayose and Kataoka, Proc. Intern. Symp. Control. Rel. Bioact. Materials, 1996, 23, 899.

In the context of the present invention, it is recommended to use living or controlled polymerization as defined by Quirk and Lee (Polymer International 27, 359 (1992)). Indeed, this particular method makes it possible to prepare polymers with a narrow dispersity and in which the length and the composition of the blocks are controlled by the stoichiometry and the degree of conversion. In the context of this type of polymerization, there are more particularly recommended the copolymers which can be obtained by any so-called living or controlled polymerization method such as, for example:

free-radical polymerization controlled by xanthates according to the teaching of Application WO 98/58974 and U.S. Pat. No. 6,153,705,
free-radical polymerization controlled by dithioesters according to the teaching of Application WO 98/01478,
free-radical polymerization controlled by dithioesters according to the teaching of Application WO 99/35178,
free-radical polymerization controlled by dithiocarbamates according to the teaching of Application WO 99/35177,
free-polymerization using nitroxide precursors according to the teaching of Application WO 99/03894,
free-radical polymerization controlled by dithiocarbamates according to the teaching of Application WO 99/31144,
free-radical polymerization controlled by dithiocarbazates according to the teaching of Application WO 02/26836,
free-radical polymerization controlled by halogenated Xanthates according to the teaching of Application WO 00/75207 and U.S. application Ser. No. 09/980,387,
free-radical polymerization controlled by dithiophosphoroesters according to the teaching of Application WO 02/10223,
free-radical polymerization controlled by a transfer agent in the presence of a disulphur compound according to the teaching of Application WO 02/22688,
atom transfer radical polymerization (ATRP) according to the teaching of Application WO 96/30421,
free-radical polymerization controlled by iniferters according to the teaching of Otu et al., Makromol. Chem. Rapid. Commun., 3, 127 (1982),
free-radical polymerization controlled by degenerative transfer of iodine according to the teaching of Tatemoto et al., Jap. 50, 127, 991 (1975), Daikin Kogyo Co Ltd Japan, and Matyjaszewski et al., Macromolecules, 28, 2093 (1995),
group transfer polymerization according to the teaching of Webster O. W., "Group Transfer Polymerization", p. 580-588, in the "Encyclopedia of Polymer Science and Engineering", Vol. 7, edited by H. F. Mark, N. M. Bikales, C. G. Overberger and G. Menges, Wiley Interscience, New York, 1987,
radical polymerization controlled by tetraphenylethane derivatives (D. Braun et al., Macromol. Symp., 111, 63 (1996)),
radical polymerization controlled by organocobalt complexes (Wayland et al., J. Am. Chem. Soc., 116, 7973 (1994)).

Preferred processes are sequenced living free-radical polymerization processes, involving the use of a transfer agent. Preferred transfer agents are agents comprising a group of formula —S—C(S)—Y—, —S—C(S)—S—, or —S—P(S)—Y—, or —S—P(S)—S—, wherein Y is an atom different from sulfur, such as an oxygen atom, a nitrogen atom, and a carbon atom. They include dithioester groups, thioether-thione groups, dithiocarbamate groups, dithiophosphoroesters, dithiocarbazates, and xanthate groups. Examples of groups comprised in preferred transfer agents include groups of formula —S—C(S)—NR—NR'2, —S—C(S)—NR—N=CR'2, —S—C(S)—O—R, —S—C(S)—CR=CR'2, and —S—C(S)—X, wherein R and R' are or identical or different hydrogen atoms, or organic groups such as hydrocarbyl groups, optionally substituted, optionally comprising heteroatoms, and X is an halogen atom. A preferred polymerization process is a living radical polymerization using xanthates.

Copolymers obtained by a living or controlled free-radical polymerization process may comprise at least one transfer agent group at an end of the polymer chain. In particular embodiment such a group is removed or deactivated.

A "living" or "controlled" radical polymerization process used to make the block copolymers comprises the steps of:

a) reacting a (mono-)alpha-ethylenically-unsaturated monomer, at least a free radicals source compound, and a transfer agent, to obtain a first block, the transfer agent being bounded to said first block, b1) reacting the first block, another (mono-)alpha-ethylenically-unsaturated monomer, and, optionally, at least a radical source compound, to obtain a di-block copolymer, b) optionally, repeating n times (n being equal to or greater than 0) step b1) to obtain a (n−2)-block copolymer, and then c) optionally, reacting the transfer agent with means to render it inactive.

For example, a "living" or "controlled" radical polymerization process used to make the di-block copolymers comprises the steps of:

a) reacting a (mono-)alpha-ethylenically-unsaturated monomer, at least a free radicals source compound, and a transfer agent, to obtain a first block, the transfer agent being bounded to said first block, b) reacting the first block, another (mono-)alpha-ethylenically-unsaturated monomer, and, optionally, at least a radical source compound, to obtain a di-block copolymer, and then c) optionally, reacting the transfer agent with means to render it inactive.

During step a), a first block of the polymer is synthesized. During step b), b1), or b2), another block of the polymer is synthesized.

Star copolymers may be prepared also by a living or controlled polymerization process involving preparing first the core and then growing branches therefrom ("core first" embodiment), or preparing first the branches and then linking the branches with a core ("arm first" embodiment.

Examples of transfer agents are transfer agents of the following formula (I):

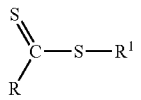

(I)

wherein:

R represents an $R^2O$—, $R^2R'^2N$— or $R^3$-group, $R^2$ and $R'^2$, which are identical or different, representing (i) an alkyl, acyl, aryl, alkene or alkyne group or (ii) an optionally aromatic, saturated or unsaturated carbonaceous ring or (iii) a saturated or unsaturated heterocycle, it being possible for these groups and rings (i), (ii) and (iii) to be substituted, $R^3$ representing H, Cl, an alkyl, aryl, alkene or alkyne group, an optionally substituted, saturated or unsaturated (hetero)cycle, an alkylthio, alkoxycarbonyl, aryloxycarbonyl, carboxyl, acyloxy, carbamoyl, cyano, dialkyl- or diarylphosphonato, or dialkyl- or diarylphosphinato group, or a polymer chain, $R^1$ represents (i) an optionally substituted alkyl, acyl, aryl, alkene or alkyne group or (ii) a carbonaceous ring which is saturated or unsaturated and which is optionally substituted or aromatic or (iii) an optionally substituted, saturated or unsaturated heterocycle or a polymer chain, and The $R^1$, $R^2$, $R'^2$ and $R^3$ groups can be substituted by substituted phenyl or alkyl groups, substituted aromatic groups or the following groups: oxo, alkoxycarbonyl or aryloxycarbonyl (—COOR), carboxyl (—COOH), acyloxy (—$O_2CR$), carbamoyl (—$CONR_2$), cyano (—CN), alkylcarbonyl, alkylarylcarbonyl, arylcarbonyl, arylalkylcarbonyl, isocyanato, phthalimido, maleimido, succinimido, amidino, guanidino, hydroxyl (—OH), amino (—$NR_2$), halogen, allyl, epoxy, alkoxy (—OR), S-alkyl, S-aryl or silyl, groups exhibiting a hydrophilic or ionic nature, such as alkaline salts of carboxylic acids or alkaline salts of sulphonic acid, poly(alkylene oxide) (PEO, PPO) chains, or cationic substituents (quaternary ammonium salts), R representing an alkyl or aryl group.

Preferably, the transfer agent of formula (I) is a dithiocarbonate chosen from the compounds of following formulae (IA), (IB) and (IC):

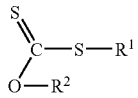

(IA)

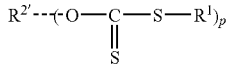

(IB)

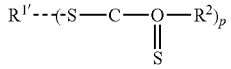

(IC)

wherein:

$R^2$ and $R^{2'}$ represent (i) an alkyl, acyl, aryl, alkene or alkyne group or (ii) an optionally aromatic, saturated or unsaturated carbonaceous ring or (iii) a saturated or unsaturated heterocycle, it being possible for these groups and rings (i), (ii) and (iii) to be substituted, $R^1$ and $R^{1'}$ represent (i) an optionally substituted alkyl, acyl, aryl, alkene or alkyne group or (ii) a carbonaceous ring which is saturated or unsaturated and which is optionally substituted or aromatic or (iii) an optionally substituted, saturated or unsaturated heterocycle or a polymer chain, and p is between 2 and 10.

Other examples of transfer agents are transfer agents of the following formulae (II) and (III):

(II)

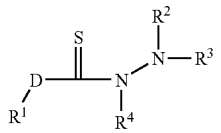

(III)

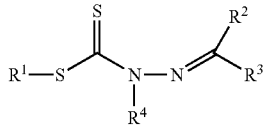

wherein $R^1$ is an organic group, for example a group $R^1$ as defined above for transfer agents of formulae (I), (IA), (IB), and (IC), $R^2$, $R^3$, $R^4$, $R^7$, and $R^8$ which are identical or different are hydrogen atoms or organic groups, optionally forming rings. Examples of $R^2$, $R^3$, $R^4$, $R^7$, and $R^8$ organic groups include hydrocarbyls, substituted hydrocarbyls, heteroatom-containing hydrocarbyls, and substituted heteroatom-containing hydrocarbyls.

The (mono-)alpha-ethylenically-unsaturated monomers and their proportions are chosen in order to obtain the desire properties for the block(s). According to this process, if all the successive polymerizations are carried out in the same reactor, it is generally preferable for all the monomers used during one stage to have been consumed before the polymerization of the following stage begins, therefore before the new monomers are introduced. However, it may happen that monomers of the preceding stage are still present in the reactor during the polymerization of the following block. In this case, these monomers generally do not represent more than 5 mol % of all the monomers.

The polymerization can be carried out in an aqueous and/or organic solvent medium. The polymerization can also be carried out in a substantially neat melted form (bulk polymerization), or according to a latex type process in an aqueous medium.

The average molecular weight of the block copolymers is usually comprised between 1000 and 500000 g/mol, more preferably between 15000 and 20000 g/mol. Within these ranges, the weight ratio of each block may vary. It is however preferred that each block has a molecular weight above 500 g/mol, and preferably above 1000 g/mol.

Detersive Surfactants

At least one detersive surfactant is comprised in the composition according to the invention. It is preferably selected from the group consisting of anionic, non-ionic, amphoteric and mixtures thereof. Examples of detersive surfactants are given below.

Anionic Surfactants

Anionic surfactants useful in the present invention are preferably selected from the group consisting of, linear alkylbenzene sulfonate, alpha olefin sulfonate, paraffin sulfonates, methyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof.

One type of anionic surfactant which can be utilized encompasses alkyl ester sulfonates. These are desirable because they can be made with renewable, nonpetroleum resources. Preparation of the alkyl ester sulfonate surfactant component can be effected according to known methods disclosed in the technical literature. For instance, linear esters of $C_8$-$C_{20}$ carboxylic acids can be sulfonated with gaseous $SO_3$ according to "The Journal of the American Oil Chemists Society," 52 (1975), pp. 323-329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

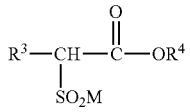

wherein R3 is a C8-C20 hydrocarbyl, preferably an alkyl, or combination thereof, R4 is a C1-C6 hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine.

Preferably, $R^3$ is $C_{10}$-$C_{16}$ alkyl, and $R^4$ is methyl, ethyl or isopropyl. Especially preferred are the methyl ester sulfonates wherein $R^3$ is $C_{14}$-$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali or alkaline (Group IA or Group IIA) metal cation (e.g., sodium, potassium, lithium, magnesium, calcium), substituted or unsubstituted ammonium cations such as methyl-, dimethyl and trimethyl ammonium and quaternary ammonium cations, e.g., tetramethylammonium and dimethyl piperdinium, and cations derived from alkanolamines such as ethanolamine, diethanolamine, triethanolamine, and mixtures thereof, and the like. Typically, alkyl chains of $C_{12}$-$C_{16}$ are preferred for lower wash temperatures (e.g., below about 50° C.) and $C_{16}$-$C_{18}$ alkyl chains are preferred for higher wash temperatures (e.g., above about 50° C.). Examples of these surfactants include surfactants sold by Rhodia under the Rhodapan Trade Name.

Alkyl alkoxylated sulfate surfactants are another category of useful anionic surfactant. These surfactants are water soluble salts or acids typically of the formula $RO(A)_mSO_3M$ wherein R is an unsubstituted $C_{10}$-$C_{24}$ alkyl or hydroxyalkyl group having a $C_{10}$-$C_{24}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are $C_{12}$-$C_{18}$ alkyl polyethoxylate (1.0) sulfate, $C_{12}$-$C_{18}$ alkyl polyethoxylate (2.25) sulfate, $C_{12}$-$C_{18}$ alkyl polyethoxylate (3.0) sulfate, and $C_{12}$-$C_{18}$ alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. Examples of these surfactants include surfactants sold by Rhodia under the Rhodapex Trade Name.

Other Anionic Surfactants—Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_8$-$C_{20}$ linear alkylbenzenesulphonates, for example sold by Rhodia under the Rhodacal trade name, $C_8$-$C_{22}$ primary or secondary alkanesulphonates, $C_8$-$C_{24}$ olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate, for example sold by Rhodia under the Geropon trade name (especially saturated and unsaturated $C_{12}$-$C_{18}$ monoesters) diesters of sulfosuccinate (especially saturated and unsaturated $C_6$-$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M+$ wherein R is a $C_8$-$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil.

Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Secondary Surfactants

Secondary detersive surfactant can be selected from the group consisting of nonionics, cationics, ampholytics, zwitterionics, and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described below.

Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl dialkyl amine oxide, for example sold by Rhodia under the Rhodamox trade name, alkyl ethoxylate, for example sold by Rhodia under the Rhodasurf trade name, alkanoyl glucose amide, alkyl betaines, for example sold by Rhodia under the Mirataine trade name, and mixtures thereof.

Other nonionic surfactants for use herein include:

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in a amount equal to from about 5 to about 25 moles of ethylene oxide per mole of alkyle phenol. Commercially available nonionic surfactants of this type include surfactants sold by Rhodia under the Igepal trade name. These are commonly referred to as phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol.

Examples of commercially available nonionic surfactants of this type include TergitolB 15-S-9 (the condensation product of $C_{11}$-$C_{15}$ linear secondary alcohol with 9 moles ethylene oxide), Tergitol 24-L-6 NMW (the condensation product of $C_{12}$-$C_{14}$ primary alcohol with 6 moles ethylene oxide with a narrow molecular weight distribution), both marketed by Union Carbide Corporation; Neodol® 45-9 (the condensation product of $C_{14}$-$C_{15}$ linear alcohol with 9 moles of ethylene oxide), Neodol® 23-6.5 (the condensation product of $C_{12}$-$C_{13}$ linear alcohol with 6.5 moles of ethylene oxide), Neodol® 45-7 (the condensation product of $C_{14}$-$C_{15}$ linear alcohol with 7 moles of ethylene oxide), Neodol® 45-4 (the condensation product of $C_{14}$-$C_{15}$ linear alcohol with 4 moles of ethylene oxide), marketed by Shell Chemical Company, Rhodasurf IT, DB, and B marketed by Rhodia, Plurafac LF 403, marketed by BASF, and Kyro® EOB (the condensation product of $C_{13}$-$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF, and Antarox, marketed by Rhodia.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available TetronicB compounds, marketed by BASF.

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula:

$$R^3(OR^4)_xN(\overset{O}{\rightarrow})(R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure. These amine oxide surfactants in particular include $C_{10}$-$C_{18}$ alkyl dimethyl amine oxides and $C_8$-$C_{12}$ alkoxy ethyl dihydroxy ethyl amine oxides.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula:

$$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the I-position). The additional glycosyl units can then be attached between their 1 position and the preceding glycosyl units 2-, 3-, 4- and/or 6-position, preferably predominantly the 2-position.

Non ionic detergent surfactant include fatty acid amide surfactants having the formula:

$$R^6-\overset{O}{\overset{\|}{C}}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$-$C_4$ alkyl, $C_1$-$C_4$ hydroxyalkyl, and $—(C^2H_4O)_xH$ where x varies from about 1 to about 3. Preferred amides are $C_8$-$C_{20}$ ammonia amides, monoethanolamides, diethanolamides, and isopropanolamides.

Cationic Surfactants

Cationic detersive surfactants can also be included in detergent compositions of the present invention. Cationic surfactants include the ammonium surfactants such as alkyldimethylammonium halogenides, and those surfactants having the formula: $[R^2(0R^3)_y][R^4(OR^3)_y]_2R^5N^+X^-$ wherein $R^2$ is an alkyl or alkyl benzyl group having from about 8 to about 18 carbon atoms in the alkyl chain, each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$-$C_4$ alkyl, $C_1$-$C_4$ hydroxyalkyl, benzyl, ring structures formed by joining the two $R^4$ groups, $—CH_2CHOHCHOHCOR^6CHOH—CH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Other Surfactants

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18-35 for examples of ampholytic surfactants. Preferred amphoteric include $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and mixtures thereof.

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 for examples of zwitterionic surfactants. Ampholytic and zwitterionic surfactants are generally used in combination with one or more anionic and/or nonionic surfactants.

Polyhydroxy Fatty Acid Amide Surfactant

The detergent compositions hereof may also contain an effective amount of polyhydroxy fatty acid amide surfactant.

By "effective amount" is meant that the formulator of the composition can select an amount of polyhydroxy fatty acid amide to be incorporated into the compositions that will improve the cleaning performance of the detergent composition. In general, for conventional levels, the incorporation of about 1%, by weight, polyhydroxy fatty acid amide will enhance cleaning performance.

The detergent compositions herein will typically comprise about 1% weight basis, polyhydroxy fatty acid amide surfactant, preferably from about 3% to about 30%, of the polyhydroxy fatty acid amide. The polyhydroxy fatty acid amide surfactant component comprises compounds of the structural formula:

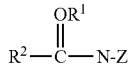

wherein:

$R^1$ is H, $C_1$-$C_4$ hydrocarbyl, 2-hydroxy ethyl, 2-hydroxy propyl, or a mixture thereof, preferably $C_1$-$C_4$ alkyl, more preferably $C_1$ or $C_2$ alkyl, most preferably $C_1$ alkyl (i.e., methyl); and $R^2$ is a $C_5$-$C_{31}$ hydrocarbyl, preferably straight chain $C_7$-$C_{19}$ alkyl or alkenyl, more preferably straight chain $C_9$-$C_{17}$ alkyl or alkenyl, most preferably straight chain $C_{11}$-$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, and alkoxylated derivatives thereof, where n is an integer from 3 to 5, inclusive, and R' is H or a cyclic or aliphatic monosaccharide. Most preferred are glycidyls wherein n is 4, particularly —$CH_2$—$(CHOH)_4$—$CH_2OH$.

R' can be, for example, N-methyl, N-ethyl, N-propyl, N-isopropyl, N-butyl, N-2-hydroxy ethyl, or N-2-hydroxy propyl.

R2-CO—N< can be, for example, cocamide. stearamide, oleamide, lauramide, myristamide, capricamide. palmitamide, tallowamide, etc.

Z can be 1-deoxyglucityl, 2-deoxyfructityl, 1-deoxymaltityl, 1-deoxylactityl, 1deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

The amount of detersive surfactant in the composition is of at least 15% by weight. The amount is preferably of at least 18%, and may even be of at least 25%.

The compositions preferably comprise from 0.33 to 20 parts by weight of the block copolymer for 100 parts of the detersive surfactant(s).

The way consumers use detergent compositions, especially for hand dishwashing, may considerably vary. Some consumer would use it almost neat (undiluted), some would dilute it. The dilution ranges can be wide. Nevertheless, best benefits in using compositions according to the invention are intended to be diluted form. Benefits are understood in terms of environment preservation (the less surfactant is used, the better), performance (it is usually not useful to use detergency compositions raw, or poorly diluted), or compromise between the amount of surfactant used and the performance.

Hence, it is preferred the total concentration of surfactants in a diluted form to be comprised between 5 and 500 ppm by weight. It is usually not useful the concentration to be greater than 4% by weight, or even 1% by weight. At such concentration no lamellar mesophase is formed, whether or not some a block copolymer is present in the diluted composition.

In the diluted form, the concentration of block copolymer according to the invention is preferably lower than 0.2% by weight, and is more preferably comprised between 1.65 ppm by weight and 100 ppm by weight.

The detergent composition according may comprise, further, other ingredients than the detersive surfactant(s) and the block copolymer. Such further ingredients may have different purposes, such as conditioning or modifying properties of the composition, and may depend of what the composition is used for. The man skilled in the art knows such further ingredients.

Further ingredients are for example builder systems, enzymes, enzyme stabilizers, rheology modifiers such as thickeners (for example gum guar), perfumes, fragrances, coloring agents, polymeric dispersing agents, brighteners, chelating agents, pH control agents, softeners, bleaching agents, antibacterial or antimicrobial agents, water, film-forming polymers, detergency adjutants, magnesium boosts, abrasives, antisoiling or soil release agents, foam boosters, foam suppressants, buffers, fillers, hydrotrope agents such as alcohols, phosphates or phosphate derivatives.

Examples of Builders systems include aluminosilicate materials, silicates, polycarboxylates and fatty acids, materials such as ethylene-diamine tetraacetate, metal ion sequestrants such as aminopolyphosphonates, particularly ethylene-diamine tetramethylene phosphonic acid and methylene triamine pentamethylene-phosphonic acid. Though less preferred for obvious environmental reasons, phosphate builders can also be used herein. Suitable polycarboxylates builders for use herein include citric acid, preferably in the form of a water-soluble salt, derivatives of succinic acid of the formula R CH(COOH)$CH_2$(COOH) wherein R is C10-20 alkyl or alkenyl, preferably C12-16, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts. Other suitable polycarboxylates are oxodisuccinates and mixtures of tartrate monosuccinic and tartrate disuccinic acid such as described in U.S. Pat. No. 4,663,071. Especially for the liquid execution herein, suitable fatty acid builders for use herein are saturated or unsaturated $C_{10}$-$C_{18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid. Detergency builder salts are normally included in amounts of from 3% to 50% by weight of the composition preferably from 5% to 30% and most usually from 5% to 25% by weight.

Enzymes are usually used to provide cleaning performance benefits, or in laundry to prevent deterioration of fabrics. Examples of enzymes include proteolitic enzymes and enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, 13-glucanases, arabinosidases, mannanases or mixtures thereof. A preferred combination is a detergent composition having a cocktail of conventional applicable enzymes like protease, amylase, lipase, cutinase and/or cellulase.

Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein include: 7acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,88-hexamethylcyclopenta-gamma-2-benzopyrane; beta-naphthol methyl ether; ambroxane; dodecahydro-3a,6,6,9a-tetramethylnaphtho[2,1b]furan; cedrol, 5-(2,2,3-trimethylcyclopent-3-enyl)-3methylpentan-2-ol; 2-ethyl-4-(2,2,3-trimethyl-3-cyclopenten 1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3 (para-tert-butylphenyl)-propionaldehyde; 7-acetyl-1,2,3,4,5,6,7,8-octahydro-I,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethyl-naphtho [2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin.

Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Compositions according to the invention may comprise Polymeric Dispersing Agents. Polymeric dispersing agents can advantageously be utilized at levels from about 0.1% to about 7%, by weight, in the compositions herein. It is believed, though it is not intended to be limited by theory, that polymeric dispersing agents enhance overall detergent performance by crystal growth inhibition, particulate soil release peptization. They also have an anti-redeposition purpose.

Polymeric polycarboxylate materials can be prepared by polymerizing or copolymerizing suitable unsaturated monomers, preferably in their acid form.

Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether styrene ethylene, etc. is suitable provided that such segments do not constitute more than about 40% by weight.

Particularly suitable polymeric polycarboxylates can be derived from acrylic acid. Such acrylic acid-based polymers which are useful herein are the watersoluble salts of polymerized acrylic acid. The average molecular weight of such polymers in the acid form preferably ranges from about 2,000 to 10,000, more preferably from about 4,000 to 7,000 and most preferably from about 4,000 to 5,000.

Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Other polymeric materials which can be included are polypropylene glycol (PPG), propylene glycol (PG), and polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Composition may include polymeric soil release agents hereinafter "SRA" or "SRA's". If utilized, SRA's will generally comprise from 0.01% to 10.0%, typically from 0.1% to 5%, preferably from 0.2% to 3.0% by weight, of the composition.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles thereby serving as an anchor for the hydrophilic segments. This can enable stains occurring subsequent to treatment with SRA to be more easily cleaned in later washing procedures.

SRA's can include a variety of charged, e.g., anionic or even cationic (see U.S. Pat. No. 4,956,447), as well as non-charged monomer units and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without of course forming a densely crosslinked overall structure.

Suitable SRA's include products as described in U.S. Pat. No. 4,968,451; U.S. Pat. No. 4,711,730; U.S. Pat. No. 4,721,580; U.S. Pat. No. 4,702,857; U.S. Pat. No. 4,877,896; U.S. Pat. No. 3,959,230; U.S. Pat. No. 3,893,929; U.S. Pat. No. 4,000,093; EP Appl. 0 219 048; U.S. Pat. No. 5,415,807; U.S. Pat. No. 4,201,824; U.S. Pat. No. 4,240,918; U.S. Pat. No. 4,525,524; U.S. Pat. No. 4,201,824; U.S. Pat. No. 4,579,681; EP 279,134A; EP 457,205; DE 2,335,044; U.S. Pat. No. 4,240,918; U.S. Pat. No. 4,787,989; U.S. Pat. No. 4,525,524; U.S. Pat. No. 4,877,896; U.S. Pat. No. 4,968,451; U.S. Pat. No. 4,702,857; U.S. application Ser. No. 08/545,351; and U.S. application Ser. No. 08/355,938. Commercially available examples include SOKALAN HP-22, available from BASF, Germany; ZELCON 5126 from Dupont; and MILEASE T from ICI.

Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7-8 acrylate units. The side-chains are of the formula $—(CH_2CH_2O)_m(CH_2)_nCH_3$ wherein m is 2-3 and n is 6-12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Another polymer dispersant form use herein includes polyethoxyatedpolyamine polymers (PPP). The preferred polyethoxylated-polyamines useful herein are generally polyalkyleneamines (PAA's), polyalkyleneimines (PAI's), preferably polyethyleneamine (PEA's), polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines.

There can also be present cyclic amines with side chains in which nitrogen atoms appear. See U.S. Pat. No. 2,792,372, Dickinson, issued May 14, 1957, which describes the preparation of PEA's.

Polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Additionally, certain alkoxylated (especially ethoxylated) quaternary polyamine dispersants are useful herein as dispersants. The alkoxylated quaternary polyamine dispersants which can be used in the present invention are of the general formula:

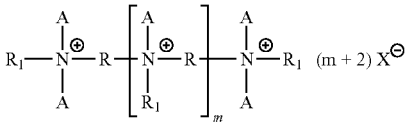

where R is selected from linear or branched C2-C12 alkylene, C3-C12 hydroxyalkylene, C4-C12 dihydroxyalkylene, C8-C12 dialkylarylene, $[(CH_2CH_2O)_qCH_2CH_2]$ and $—CH_2CH(OH)CH_2O—(CH_2CH_2O)_qCH_2CH(OH)CH_2]—$ where q is from about 1 to about 100. If present, each $R_1$ is independently selected from C1-C4 alkyl C7-C12 alkylaryl, or A. $R_1$ may be absent on some nitrogens; however, at least three nitrogens must be quaternized.

A is of the formula:

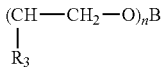

where $R_3$ is selected from H or C1-C3 alkyl, n is from about 5 to about 100 and B is selected from H, C1-C4 alkyl, acetyl, or benzoyl; m is from about 0 to about 4, and X is a water soluble anion.

In preferred embodiments, R is selected from C4 to C8 alkylene, $R_1$ is selected from C1-C2 alkyl or C2-C3 hydroxyalkyl, and A is:

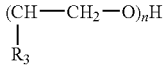

where $R_3$ is selected from H or methyl, and n is from about 10 to about 50; and m is 1.

In another preferred embodiment R is linear or branched C6, R1 is methyl, $R_3$ is H, and n is from about 20 to about 50, and m is 1.

The levels of these dispersants used can range from about 0.1% to about 10%, typically from about 0.4% to about 5%, by weight. These dispersants can be synthesized following the methods outline in U.S. Pat. No. 4,664,848, or other ways known to those skilled in the art.

Any optical brighteners or other brightening or whitening agents known in the art can be incorporated at levels typically from about 0.01% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include:

Tinopal UNPA, Tinopal CBS and Tinopal 5BM; available from Ciba-Geigy; Artic White CC and Artic White CWD, the 2-(4-styryl-phenyl)-2H-naptho[1,2-d]triazoles; 4,4'-bis-(1,2,3-triazol-2-yl)-stilbenes; 4,4'-bis(styryl)bisphenyls; and the aminocoumarins. Specific examples of these brighteners include 4-methyl-7diethyl-amino coumarin; 1,2-bis(benzimidazol-2-yl)ethylene; 1,3-diphenylpyrazolines; 2,5-bis(benzoxazol-2-yl)thiophene; 2-styryl-naptho [1,2-d]oxazole; and 2-(stilben-4-yl)-2H-naphtho[192-d]triazole. See also U.S. Pat. No. 3,646,015, issued Feb. 29, 1972 to Hamilton.

Composition according to the invention may comprise Cheating Agents. The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to exceptional ability to remove iron and manganese ions form washing solutions by formation of soluble chelates.

Amino carboxylates useful as optional chelating agents include ethylenediaminetetracetates, N-hydroxyethylethylenediaminetriacetates, nitrilo-triacetates, ethylenediamine terapropinates, triethylenetetraamineshexacetates, diethylenetriaminepentaacetates, and ethanoldiglicynes, alkali metal, ammonium, and substituted ammonium salts therein and mixture therein.

Amino phosphonates are also suitable for use as chelating agents in the compositions of the invention when at least low levels of total phosphorous are permitted in detergent compositions, and include ethylenediaminetetrakis(methylenephophonates) as DEQUEST. Preferred, these amino phosphonates do not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Composition may comprise pH control agents. For example Dishwashing compositions are subjected to acidic stresses created by food soils when put to use, i.e., diluted and applied to soiled dishes. If a composition with a pH greater than 7 is to be more effective, it preferably should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri(hydroxymethyl)amino methane (HOCH2)3CNH3 (TRIS), 2-amino-2-ethyl-1,3-propanediol, 2-amino-2methyl-propanol, 2-amino-2-methyl-1,3-propanol, disodium glutamate, N-methyl diethanolamide, 1,3-diamino-propanol N,N'-tetramethyl-1,3-diamino-2-propanol, N,N-bis(2-hydroxyethyl) glycine (bicine) and N-tris (hydroxymethyl)methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The buffering agent, if used, is present in the compositions of the invention herein at a level of from about 0.1% to 15%, preferably from about 1% to 10%, most preferably from about 2% to 8%, by weight of the composition.

Examples of antibacterial or antimicrobial agents are compounds comprising a quaternary ammonium group. It e a polymeric compound comprising such groups.

Examples of film forming polymers is anionic guar. Examples of detergency adjutants are phosphates, silicates.

EXAMPLE

Grease Removal

Grease removal is measured by determining the amount of fatty soil (Crisco™) a detergent solution can remove from a beaker. The soil is prepared my mixing shortening and vegetable oil (Crisco™) for 10 minutes at 60° C. 30 mL of this fat soil is poured into a beaker and allowed to resolidify over 24 hours at constant temperature and humidity (21° F., 50% RH). The beakers containing fat is then weighed. A concentrate detergent solution described in Table 1 is diluted to a concentration by weight of 0.03% of surfactant, using water with 30 ppm water hardness. Polymer additives being studied are added at 1 weight % based on the detergent concentrate solution (i.e. 0.002 weight % based on the diluted solution). The diluted detergent solution comprising the additive being studied is heated to 50° C. and then 15 mL of it is added to the beaker containing the fat soil. The detergent solution is allowed to stay undisturbed in contact with the fat soil for 40 minutes. The detergent solution plus any loosed fatty material is then poured off from the beaker. The inside walls of the beaker are wiped with a dry paper towel to remove any residue. The beakers with the remaining fatty material are then left standing for another 24 hours at constant temperature and humidity (21° C., 50% RH). Following this 24 hours period, the beaker is weighed again.

The percent removal on table 2 is calculated by determining the before and after weight of the beaker, and calculating the percent more or less removed by the detergent solution plus additive relative to the detergent solution without additive (same protocol).

TABLE 1

| Component | |
|---|---|
| NaDDBSA | 10% |
| Rhodasurf LA7, | 5% |
| EtOH | 3% |
| Sodium citrate | 3% |

NaDDBSA: sodium dodecylbenzene sulfonate (Rhodacal LDS22, marketed by Rhodia)
Rhodasurf LA7: a surfactant marketed by Rhodia being linear lauryl and coco alcohol ethoxylate with 7 Ethylene Oxide units.

TABLE 2

| Polymeric additive | % removal |
|---|---|
| Polydimethylaminoethyl methacrylate (Comparative) | −36.240856 |
| MAPTAC[2]: Acrylic acid copolymer (Comparative) | 27.770093 |
| Commercial detergent polyacrylate (Comparative) | 14.304806 |
| PBA[4]-PAA[5] 50/50[1] diblock copolymer | 78.775125 |
| PBA[4]-PAA[5] 55/45[1] diblock copolymer | 58.393357 |
| PBA[4]-PAA[5] 60/40[1] diblock copolymer | 68.481082 |
| PBA[4]-PAA[5] 70/30[1] diblock copolymer | 69.184159 |
| PAA[5]-PAM[6] 3K/7K[2] diblock copolymer | 64.016569 |
| PAA[5]-PAM[6] 1K/5K[2] diblock copolymer | 73.698188 |
| PS[7]-PAA[5] 1K/15K[2] diblock copolymer | 45.329958 |
| PS[7]-PAA[5] 3K/13K[2] diblock copolymer | 59.353855 |
| PS[7]-PAA[5] 2K/14K** diblock copolymer | 54.67285 |
| PVA[8]-PAA[5] 7.5K/7.5K** diblock copolymer | 67.554238 |
| PVA[8]-PAA[5] 5K/10K** diblock copolymer | 63.424267 |

[1]weight % of each block, the total molecular weight being 25K.
[2]molecular weight of each block K is 1000 g/mol
[3]MAPTAC: (methacrylamidopropyl)trimethylammonium chloride
[4]polybutylacrylate block
[5]polyacrylic acid block
[6]polyacrylamide block
[7]polystyrene block
[8]polyvinylalcohol block
% removal of grease is improved for composition comprising block copolymer according to the invention.

The invention claimed is:

1. A dishwashing process comprising the step of treating a substrate with a detergent composition in neat or dilute form, said composition comprising:

at least 15% of a detersive surfactant(s)

a block copolymer comprising a (block A)-(block B) diblock copolymer, a (block A)-(block B)-(block A) triblock copolymer, a (block B)-(block A)-(block B) triblock copolymer, or a mixture thereof, wherein:

block A and block B derive from alpha-ethylenically-unsaturated monomers;

block A comprises a block that is water soluble or hydrophobic, and is neutral at a pH the composition is used;

block B comprises a water-soluble block that is anionic at the pH the composition is used;

the molecular weight ratio of block A to block B ranges from 1/15 to 7/3; and further wherein the composition is effective for dishwashing.

2. The dishwashing process of claim 1, wherein said composition comprises a liquid.

3. The dishwashing process of claim 1, wherein said composition comprises at least 18% of detersive surfactant(s).

4. The dishwashing process of claim 1, wherein said composition comprises at least 25% of a detersive surfactant.

5. The dishwashing process of claim 1, wherein said composition comprises at most 40% water.

6. The dishwashing process of claim 1, wherein said composition comprises from 0.33 to 20 weight parts of the block copolymer, per 100 parts of surfactant(s).

7. The dishwashing process of claim 1, wherein neutral block A comprises units deriving from at least one monomer comprising:

vinyl acetate, vinyl alcohol, vinyl pyrrolidone, acrylonitrile, amides of (mono-)alpha-ethylenically-unsaturated monocarboxylic acids, alkyl esters of (mono-)alpha-ethylenically-unsaturated monocarboxylic acids, vinyl nitriles, hydroxyalkylacrylates, hydroxyalkymethacrylates, vinylamine amides, and/or vinyl aromatic compounds.

8. The dishwashing process of claim 7, wherein neutral block A comprises units deriving from at least one monomer comprising:

styrene, acrylamide, methacrylamide, methylacrylate, ethylacrylate, n-propylacrylate, n-butylacrylate, methylmethacrylate, ethylmethacrylate, n-propylmethacrylate, n-butylmethacrylate, 2-ethylhexyl acrylate, and/or 2-hydroxyethylacrylate, or 2-hydroxyethylmethacrylate.

9. The dishwashing process of claim 1, wherein anionic block B comprises units deriving from at least one monomer comprising:

(mono-)alpha-ethylenically-unsaturated monomers comprising a phosphate or phosphonate group, (mono-)alpha-ethylenically-unsaturated monocarboxylic acids, monoalkylesters of (mono-)alpha-ethylenically-unsaturated dicarboxylic acids, monoalkylamides of (mono-)alpha-ethylenically-unsaturated dicarboxylic acids, and/or (mono-)alpha-ethylenically-unsaturated compounds comprising a sulfonic acid group, or salts of (mono-)alpha-ethylenically-unsaturated compounds comprising a sulfonic acid group.

10. The dishwashing process of claim 9, wherein anionic block B comprises units deriving from at least one monomer comprising:

acrylic acid, methacrylic acid, vinyl sulfonic acid, salts of vinyl sulfonic acid, vinylbenzene sulfonic acid, salts of vinylbenzene sulfonic acid, alpha-acrylamidomethylpropanesulfonic acid, salts of alpha-acrylamidomethylpropanesulfonic acid 2-sulfoethyl methacrylate, salts of 2-sulfoethyl methacrylate, acrylamido-2-methylpropanesulfonic acid (AMPS), salts of acrylamido-2-methylpropanesulfonic acid, and/or styrenesulfonate (SS).

11. The dishwashing process of claim 1, wherein:

block A comprises units deriving from at least one monomer comprising:

acrylamide, methacrylamide, vinyl pyrrolidone, vinyl alcohol, and/or hydroxyalkylacrylates or hydroxyalkymethacrylates; and block B comprises units deriving from at least one monomer comprising:

(mono-)alpha-ethylenically-unsaturated monomers comprising a phosphate or phosphonate group, (mono-)alpha-ethylenically-unsaturated monocarboxylic acids, monoalkylesters of (mono-)alpha-ethylenically-unsaturated dicarboxylic acids, monoalkylamides of (mono-)alpha-ethylenically-unsaturated dicarboxylic acids, and/or (mono-)alpha-ethylenically-unsaturated compounds comprising a sulfonic acid group, or salts of alpha-ethylenically-unsaturated compounds comprising a sulfonic acid group.

12. The dishwashing process of claim 1, wherein:

block A comprises units deriving from at least one monomer comprising 2-hydroxyethylacrylate, and, block B comprises units deriving from at least one monomer comprising:

acrylic acid, methacrylic acid, vinyl sulfonic acid, salts of vinyl sulfonic acid, vinylbenzene sulfonic acid, salts of vinylbenzene sulfonic acid, alpha-acrylamidomethylpropanesulfonic acid, salts of alpha-acrylamidomethylpropanesulfonic acid 2-sulfoethyl methacrylate, salts of 2-sulfoethyl methacrylate, acrylamido-2-methylpropanesulfonic acid (AMPS), salts of acrylamido-2-methylpropanesulfonic acid, and/or styrenesulfonate (SS).

13. The dishwashing process of claim 1, wherein block A is hydrophobic and comprises units deriving from at least one monomer comprising:

vinyl nitriles, comprising from 3 to 12 carbon atoms, vinylamine amides, and/or vinylaromatic compounds.

14. The dishwashing process of claim 1, wherein block A is hydrophobic and comprises units deriving from at least one monomer comprising:

styrene, acrylonitrile, and/or methylacrylate, ethylacrylate, n-propylacrylate, n-butylacrylate, methylmethacrylate, ethylmethacrylate, n-propylmethacrylate, n-butylmethacrylate, or 2-ethylhexyl acrylate.

15. The dishwashing process of claim 1, wherein the block copolymer comprises a di-block (block A)-(block B) copolymer, and wherein:

block A derives from a vinyl alcohol monomer, and block B derives from an acrylic acid monomer;

block A derives from a styrene monomer, and block B derives from an acrylic acid monomer;

block A derives from a butylacrylate'monomer, and block B derives from an acrylic acid monomer;

block A derives from a butylacrylate monomer, and block B derives from a 2-acrylamido-2-methylpropane-sulfonic acid (AMPS) monomer; or block A derives from an acrylamide monomer, and block B derives from an acrylic acid monomer.

16. The dishwashing process of claim 1, wherein the block copolymer is obtained by a living or controlled free-radical polymerization process.

17. The dishwashing process of claim 1, wherein the detersive surfactant(s) comprises anionic surfactants, non-ionic surfactants, or mixtures thereof.

18. The dishwashing process of claim 1, wherein said block copolymer comprises a (block A)-(block B)-(block A) or a (block B)-(block A)-(block B) tri-block copolymer.

* * * * *